US006594454B2

(12) United States Patent
Oguma et al.

(10) Patent No.: US 6,594,454 B2
(45) Date of Patent: Jul. 15, 2003

(54) ELECTRIC CONTACT MEMBER AND DEVELOPING DEVICE, PROCESS CARTRIDGE, AND ELECTROPHOTOGRAPHIC IMAGE-FORMING APPARATUS USING THE ELECTRIC CONTACT MEMBER

(75) Inventors: Toru Oguma, Shizuoka (JP); Kazushi Watanabe, Shizuoka (JP); Toshiyuki Karakama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,582

(22) Filed: Nov. 20, 2001

(65) Prior Publication Data

US 2002/0064390 A1 May 30, 2002

(30) Foreign Application Priority Data

Nov. 28, 2000 (JP) ..... 2000-361100

(51) Int. Cl.[7] ..... G03G 15/00

(52) U.S. Cl. ..... 399/90

(58) Field of Search ..... 399/90, 111, 265, 399/270, 285, 116, 117, 167

(56) References Cited

U.S. PATENT DOCUMENTS

| | | | | |
|---|---|---|---|---|
| 5,283,619 A | | 2/1994 | Nomura et al. | |
| 5,316,129 A | * | 5/1994 | Daily | 198/780 |
| 5,331,372 A | | 7/1994 | Tsuda et al. | |
| 5,345,294 A | | 9/1994 | Nomura et al. | |
| 5,404,198 A | | 4/1995 | Noda et al. | |
| 5,470,635 A | | 11/1995 | Shirai et al. | 428/131 |
| 5,475,470 A | | 12/1995 | Sasago et al. | |
| 5,488,459 A | | 1/1996 | Tsuda et al. | |
| 5,500,714 A | | 3/1996 | Yashiro et al. | |
| 5,510,878 A | | 4/1996 | Noda et al. | |
| 5,543,898 A | | 8/1996 | Shishido et al. | |
| 5,583,613 A | | 12/1996 | Kobayashi et al. | |
| 5,602,623 A | | 2/1997 | Nishibata et al. | 399/111 |
| 5,608,509 A | | 3/1997 | Shirai et al. | 399/351 |
| 5,617,579 A | | 4/1997 | Yashiro et al. | 399/114 |
| 5,623,328 A | | 4/1997 | Tsuda et al. | 399/111 |
| 5,630,196 A | * | 5/1997 | Swain | 399/117 |
| 5,659,847 A | | 8/1997 | Tsuda et al. | 399/113 |
| 5,669,042 A | | 9/1997 | Kobayashi et al. | 399/111 |
| 5,689,774 A | | 11/1997 | Shishido et al. | 399/111 |

(List continued on next page.)

FOREIGN PATENT DOCUMENTS

| | | | | |
|---|---|---|---|---|
| JP | 05204283 A | * | 8/1993 | G03G/21/00 |
| JP | 5-257378 | | 10/1993 | |

*Primary Examiner*—Robert Beatty
(74) *Attorney, Agent, or Firm*—Fitzpatrick, Cella, Harper & Scinto

(57) ABSTRACT

An electric contact member for applying a development bias voltage to a development sleeve for developing an electrostatic latent image formed on an electrophotographic photosensitive drum which electric contact member is used by being attached to a flange to be attached to an end portion of the development sleeve. The electric contact member includes: a coil spring portion for being electrically connected with a frame side electrode provided on a frame supporting the development sleeve, which coil spring portion is projected from one end portion of the flange when the electric contact member is attached to the flange; a contact portion for contacting with an inner surface of the development sleeve when the flange, to which the electric contact member is attached, is attached to the end portion of the development sleeve, which contact portion is to be projected from the other end portion of the flange; and a connecting portion for connecting the coil spring portion and the contact portion, which connecting portion is disposed in the inside of the flange when the electric contact member is attached to the flange. The flange includes a plurality of axially extending ribs disposed on its inner surface which serve to position the connecting portion.

12 Claims, 7 Drawing Sheets

U.S. PATENT DOCUMENTS

| | | | | |
|---|---|---|---|---|
| 5,768,658 | A | 6/1998 | Watanabe et al. | 399/111 |
| 5,768,660 | A | 6/1998 | Kurihara et al. | 399/111 |
| 5,815,782 | A | 9/1998 | Yokomori et al. | 399/285 |
| 5,828,928 | A | 10/1998 | Sasago et al. | 399/111 |
| 5,878,310 | A | 3/1999 | Noda et al. | 399/117 |
| 5,884,124 | A | 3/1999 | Karakama et al. | 399/123 |
| 5,899,602 | A | 5/1999 | Noda et al. | 399/111 |
| 5,966,566 | A | 10/1999 | Odagawa et al. | 399/109 |
| 5,966,568 | A | 10/1999 | Numagami et al. | 399/111 |
| 6,016,413 | A | 1/2000 | Yokoyama et al. | 399/113 |
| 6,070,028 | A | 5/2000 | Odagawa et al. | 399/104 |
| 6,097,909 | A | 8/2000 | Watanabe et al. | 399/111 |
| 6,144,398 | A | 11/2000 | Yokoyama et al. | 347/263 |
| 6,163,665 | A | 12/2000 | Watanabe et al. | 399/111 |
| 6,246,849 | B1 | 6/2001 | Yokoyama et al. | 399/117 |
| 6,272,299 | B1 | 8/2001 | Numagami et al. | 399/111 |

* cited by examiner

ELECTRIC CONTACT MEMBER AND DEVELOPING DEVICE, PROCESS CARTRIDGE, AND ELECTROPHOTOGRAPHIC IMAGE-FORMING APPARATUS USING THE ELECTRIC CONTACT MEMBER

BACKGROUND OF THE INVENTION

1. Field of the Invention

The present invention relates to an electric contact member, and a developing device, a process cartridge, and an electrophotographic image-forming apparatus, all using the electric contact member.

Hereupon, the electrophotographic image-forming apparatus is an apparatus for forming an image on a recording medium by use of the electrophotographic image-forming process. Then, examples of the electrophotographic image-forming apparatus include, for example, an electrophotographic copying machine, an electrophotographic printer (for example, a laser beam printer, an LED printer and the like), a facsimile apparatus, a word processor and the like.

Moreover, the process cartridge is a cartridge into which at least developing means and an electrophotographic photosensitive drum are integrally incorporated, and which is detachably mountable to a main body of an electrophotographic image-forming apparatus.

2. Description of the Related Art

At present, image-forming apparatuses using the electrophotographic image-forming process are widely used. The image-forming apparatus performs image recording through the following processes: a latent image is formed by the light irradiation corresponding to an image signal on an electrophotographic photosensitive member; a developer (hereinafter referred to as toner) is fed to the electrophotographic photosensitive member by the rotation of a developer bearing member; and a developing bias is applied to transfer a toner image on a recording medium.

Such an electrophotographic image-forming apparatus using the electrophotographic image-forming process uses a process cartridge system in which an electrophotographic photosensitive member and process means acting on the electrophotographic photosensitive member are integrally made into a cartridge, which is detachably mountable to the main body of the electrophotographic image-forming apparatus. Because, by the use of the process cartridge system, a user can perform the maintenance of the apparatus in person without relying on a serviceperson, the operating property of the apparatus can remarkably be improved. Accordingly, the process cartridge system is widely employed in electrophotographic image-forming apparatuses.

FIG. 2 is a diagram showing the structures of a developer bearing member (hereinafter referred to as a development sleeve) and a photosensitive drum of a process cartridge. The photosensitive drum 51 is rotatably supported by a frame 59 of the process cartridge. The development sleeve 50 is disposed with a predetermined space from the photosensitive drum 51 with spacer runners 52 and 53 that are fitted onto both of the ends of the development sleeve 50. The development sleeve 50 is composed of a sleeve cylinder 57 of an aluminum pipe, a magnet roller 56 disposed in the sleeve cylinder 57, sleeve flanges 54 and 55 made of resin, a sleeve electrode 58 for applying a developing bias to the development sleeve 50, and the like.

FIG. 3 is a perspective view showing the structures of the sleeve flange 54 and the sleeve electrode 58. The sleeve electrode 58 includes a contact portion 58*a* conducting electricity to the sleeve cylinder 57, and a contact portion 58*b* conducting electricity to a developing bias electrode 60 formed on the process cartridge frame 59, to which contact portion 58*b* a developing bias voltage, from the main body of the electrophotographic image-forming apparatus, is applied. The sleeve electrode 58 is attached to the sleeve flange 54. On the surface of the sleeve flange 54, a groove 54*a* along the shape of the sleeve electrode 58 is formed. The sleeve flange 54 is force-fitted into the sleeve cylinder 57 with the sleeve electrode 58 fitted into the groove 54*a*, and the contact portion 58*a* and the inner peripheral surface of the sleeve cylinder 57 contact each other to conduct electricity therebetween.

The development sleeve 50 constructed in such a way is rotatably attached to the process cartridge frame 59 as shown in FIG. 2, and the sleeve electrode 58 and the developing bias electrode 60 electrically contact each other.

The present invention is one that has further developed the aforesaid conventional art.

SUMMARY OF THE INVENTION

One object of the present invention is to provide an electric contact member capable of applying a development bias voltage more surely to a development sleeve, and a developing device, a process cartridge and an electrophotographic image-forming apparatus, all using the electric contact member.

Another object of the invention is to provide an electric contact member capable of applying a development bias voltage more stably to a development sleeve, and a developing device, a process cartridge and an electrophotographic image-forming apparatus, all using the electric contact member.

A further object of the invention is to provide an electric contact member for further improving a circularity of a flange, and a developing device, a process cartridge and an electrophotographic image-forming apparatus, all using the electric contact member.

A still further object of the invention is to provide an electric contact member which can stably perform an electric contact with a frame side electrode, and a developing device, a process cartridge and an electrophotographic image-forming apparatus, all using the electric contact member.

A still further object of the invention is to provide an electric contact member a part of which is disposed in the inside of a flange, and a developing device, a process cartridge and an electrophotographic image-forming apparatus, all using the electric contact member.

A still further object of the invention is to provide an electric contact member comprising:

a coil spring portion for being electrically connected with a frame side electrode formed on a frame supporting a development sleeve, the coil spring portion being to be projected from one end portion of the flange when the electric contact member is attached to the flange;

a contact portion for contacting with the inner surface of the development sleeve when the flange, to which the electric contact member is attached, is attached to an end portion of the development sleeve, the contact portion being to be projected from the other end portion of the flange; and a connecting portion for connecting the coil spring portion and the contact portion, the connecting portion being to be disposed in the inside of the flange when the electric contact member is attached to the flange, and a developing device, a process cartridge and an electrophotographic image-forming apparatus, all using the electric contact member.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A description is given to a process cartridge according to an embodiment of the present invention and an electrophotographic image-forming apparatus using the process cartridge.

[Description of the Overall Electrophotographic Image-Forming Apparatus]

Figure 4:
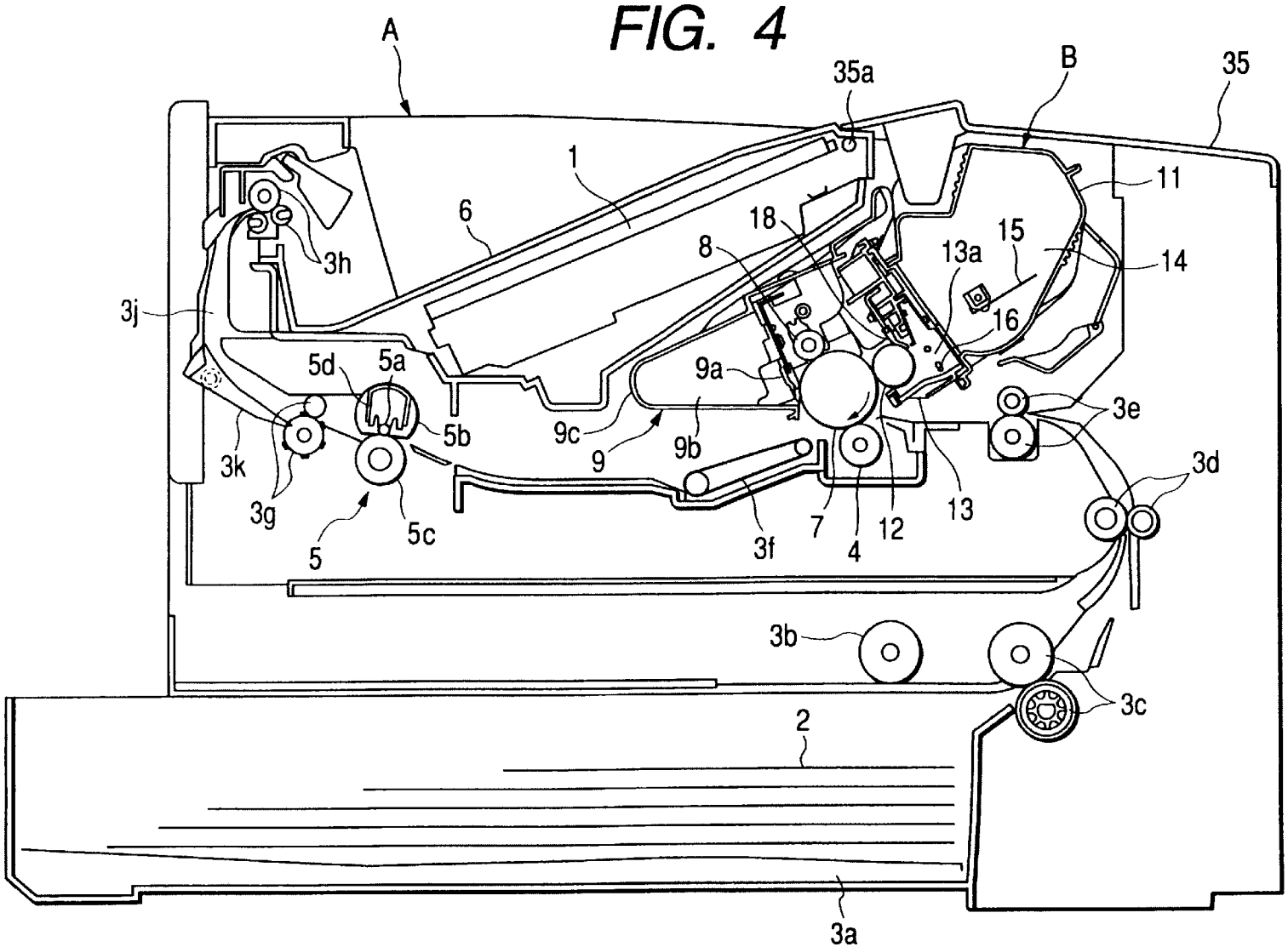
FIG. 4 is a schematic diagram showing a longitudinal section of an electrophotographic image-forming apparatus A with a process cartridge B of the present invention being mounted thereon.
Figure 5:
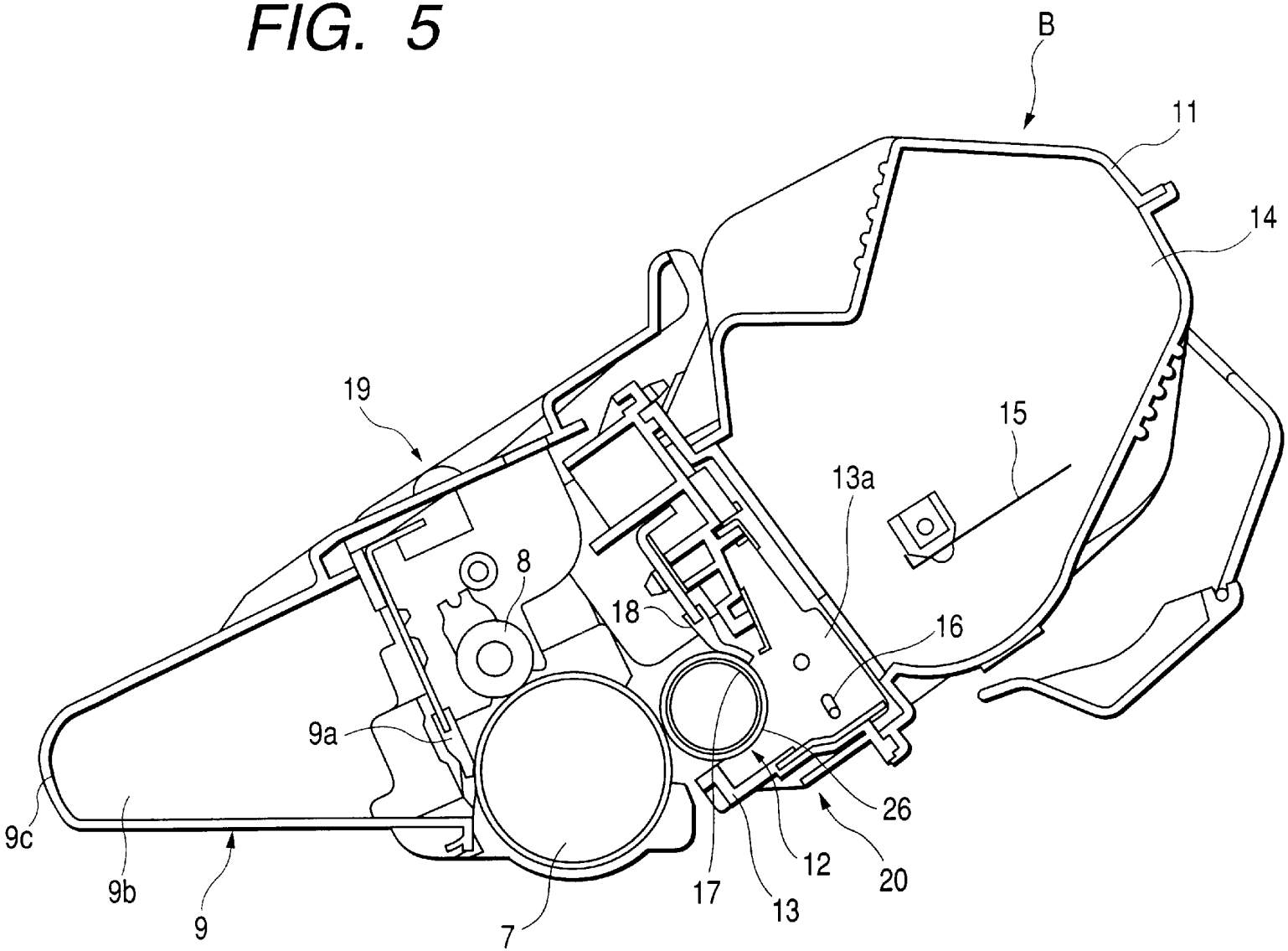
FIG. 5 is a longitudinal section of the process cartridge B of the invention.

At first, the overall construction of the electrophotographic image-forming apparatus (hereinafter referred to as an image-forming apparatus A) is described with reference to FIGS. 4 and 5. FIG. 4 is a schematic diagram showing a longitudinal section of the image-forming apparatus A with the process cartridge B being mounted in the image-forming apparatus A. Moreover, FIG. 5 is a longitudinal section of the process cartridge B.

As shown in FIG. 4, a drum-shaped electrophotographic photosensitive member (hereinafter referred to as a photosensitive drum 7) is mounted on the process cartridge B in the image-forming apparatus A. The photosensitive drum 7 rotates in the direction indicated by the arrow in FIG. 4 and is charged by a charging roller 8 being charging means. Next, optical means 1 including a laser diode, a polygon mirror, a lens and a reflection mirror projects a laser beam, modulated according to image information, onto the photosensitive drum 7, thereby forming a latent image according to the image information on the photosensitive drum 7. The latent image is developed by developing means to be made into a toner image being a visual image.

The developing means is composed of a development sleeve 12 being a developer bearing member for feeding a developer (toner) to the photosensitive drum 7, and a developing blade 18 being a regulating member for regulating the amount of developer adhering to the surface of the development sleeve 12. Moreover, the development sleeve 12, the developing blade 18, a developing frame 13 for holding the sleeve 12 and the blade 18, and a toner container 11 (also called as a developer frame) containing developer are connected to constitute a developing unit 20 being a developing device.

The outer surface of the development sleeve 12 forms a sleeve cylinder 26 (see FIG. 5) made of a substantially cylindrical aluminum pipe, and the development sleeve 12 is rotatably supported by the developing frame 13. A magnet roller 17 made of a permanent magnet is built in the sleeve cylinder 26. The magnet roller 17 is fixed to the developing frame 13, and the sleeve cylinder 26 rotates on the outer periphery of the magnet roller 17. Moreover, the developing blade 18 is disposed substantially in parallel to the development sleeve 12 with an appropriate interval from development sleeve 12.

Then, the toner container 11 forms a toner containing portion 14 for containing toner being a developer, and the toner container 11 is provided with a toner feeding member 15 for feeding the toner in the toner containing portion 14. The toner feeding member 15 includes a plastic sheet having flexibility and elasticity. The toner container 11 forms the toner containing portion 14, and is fixed to the developing frame 13 to feed the toner in the toner containing portion 14 to the developing frame 13.

The developing frame 13 includes a developing chamber 13*a*, and the toner in the toner containing portion 14 adjoining the developing chamber 13*a* is fed to the developing chamber 13*a* by the rotation of the toner feeding member 15. The developing frame 13 is provided with a rotatable toner agitating member 16 in the vicinity of the development sleeve 12 to circulate the toner, which has been fed from the toner containing portion 14 and is now in the developing chamber 13*a*, by the rotation of the toner agitating member 16. Moreover, because the toner has magnetism and the sleeve cylinder 26 has the magnet roller 17 therein, the toner adheres on the sleeve cylinder 26.

Then, the toner is carried by the rotation of the sleeve cylinder 26, and triboelectification charges are induced in the toner by the developing blade 18. Then, a toner layer of a predetermined thickness is formed on the development sleeve 12, and the toner is carried to the developing area of the photosensitive drum 7. The toner fed to the developing area is shifted to the latent image on the photosensitive drum 7 to form a toner image on the photosensitive drum 7. Incidentally, the development sleeve 12 is connected to a developing bias circuit provided in the main body of the image-forming apparatus A, and generally a developing bias voltage in which a direct-current voltage is superimposed on an alternating voltage is applied to the development sleeve 12.

On the other hand, a recording medium 2 set on a feed cassette 3*a* is transported to a transferring position in synchronism with the formation of the toner image by a pickup roller 3*b*, transporting roller pairs 3*c* and 3*d* and a registration roller pair 3*e*. A transfer roller 4 as transferring means is disposed at the transferring position, and the toner image on the photosensitive drum 7 is transferred onto the recording medium 2 by the application of a voltage on the transfer roller 4.

The recording medium 2, on which the toner image has been transferred, is transported to fixing means 5 by a transporting guide 3*f*. The fixing means 5 is provided with a driving roller 5*c*, and a fixing rotary member 5*b* being a tubular sheet which has a heater 5*a* therein and is supported by a supporting member 5*d*. The fixing means 5 applies heat and pressure on a passing recording medium 2 to fix a transferred toner image on the recording medium 2.

The recording medium 2, on which the toner image has been fixed, is transported by a delivery roller pair 3*g*, and then is delivered to a delivery tray 6 by a delivery roller pair 3*h* through a surface reverse path 3*j*. The delivery tray 6 is set on the upper surface of the image-forming apparatus A. Incidentally, it is also possible to deliver the recording medium 2 by operating a pivotally movable flapper 3*k* without passing through the surface reverse path 3*j*. In the present embodiment, the pickup roller 3*b*, the transporting roller pairs 3*c* and 3*d*, the registration roller pair 3*e*, the transporting guide 3*f* and the delivery roller pairs 3*g* and 3*h* constitute transporting means.

Moreover, the photosensitive drum 7 after having transferred the toner image onto the recording medium 2 with the transferring roller 4 prepares for the next image-forming process after the residual toner on the photosensitive drum 7 has been removed by cleaning means 9. The cleaning means 9 is composed of an elastic cleaning blade 9*a* disposed to abut against the photosensitive drum 7 and a removed toner reservoir 9*b* for containing the residual toner. The removed toner reservoir 9*b* is formed by a cleaning frame 9*c*, and further the cleaning frame 9*c* supports the cleaning blade 9*a*. The cleaning means 9 scrapes off the residual toner on the photosensitive drum 7 with the cleaning blade 9*a*, and collects the scraped toner into the removed toner reservoir 9*b*.

[Description of Process Cartridge]

On the other hand, as shown in FIG. 5, in the present embodiment, the process cartridge B forms the developing unit 20 (developing apparatus) as a united body by the welding of the toner container 11 to the developing frame 13 provided with the developing means. The toner container 11 forms the toner containing portion 14 for containing toner, and supports the toner feeding member 15 rotatably in the toner containing portion 14. The developing frame 13 holds the developing blade 18 and the development sleeve 12 as the developing means.

Moreover, the cleaning means 9 including the cleaning blade 9*a* and the like, the photosensitive drum 7 and the charging roller 8 are supported by the cleaning frame 9*c* to form the cleaning unit 19.

Then, the process cartridge B combines the developing unit 20 and the cleaning unit 19 rotatably and is made into a one united body as a cartridge.

Figure 8:
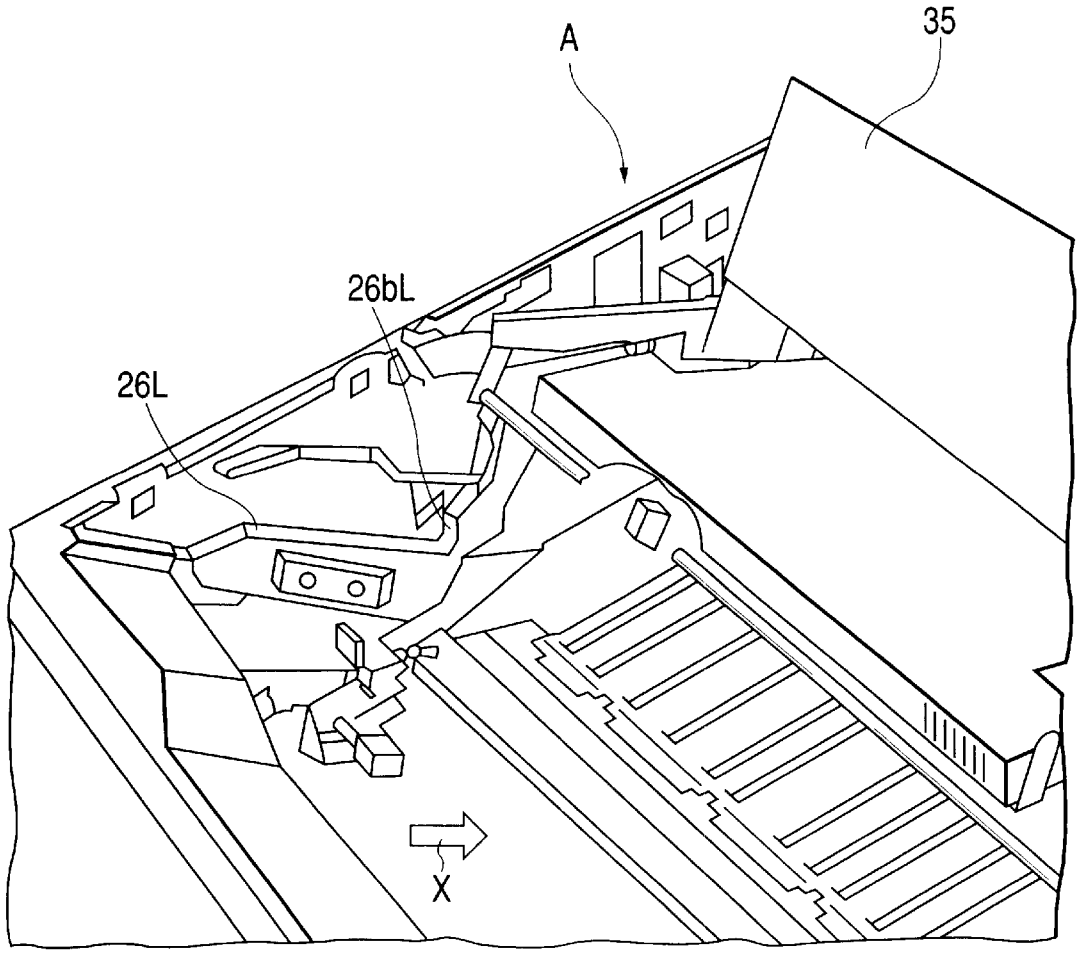
FIG. 8 is a perspective view showing a state in that an opening and closing member of the image-forming apparatus A of the invention is opened.

Next, a method of mounting the process cartridge B to and dismounting the process cartridge B from the main body of the image-forming apparatus A will be described with reference to FIG. 4 and FIG. 8. FIG. 8 is a perspective view showing a state in that an opening and closing member 35 of the image-forming apparatus A is opened. When the opening and closing member 35 of the image-forming apparatus A is opened around a hinge 35*a* shown in FIG. 4, forwardly descent right and left guide rails 26L and 26R (26R is not shown) can be seen on the right and left inner walls of the image-forming apparatus A. Then, right and left cylindrical guides (not shown) coaxial with the photosensitive drum 7 and attitude determining elongated guides (not shown) situated behind the cylindrical guides as viewed along the mounting direction of the process cartridge B onto the main body of the apparatus A are inserted into the guide rails 26L and 26R, and then the cylindrical guides are fitted into positioning grooves 26*b*L and 26*b*R (26*b*R is not shown) of the image-forming apparatus A. Thereby, the process cartridge B is mounted in the image-forming apparatus A.

On the contrary, when the process cartridge B mounted in the image-forming apparatus A is removed, the removal is performed by the pulling-out of the process cartridge B along the guide rails 26L and 26R in the reverse order of the aforesaid order.

[Descriptions of Development Sleeve]

Figure 1:
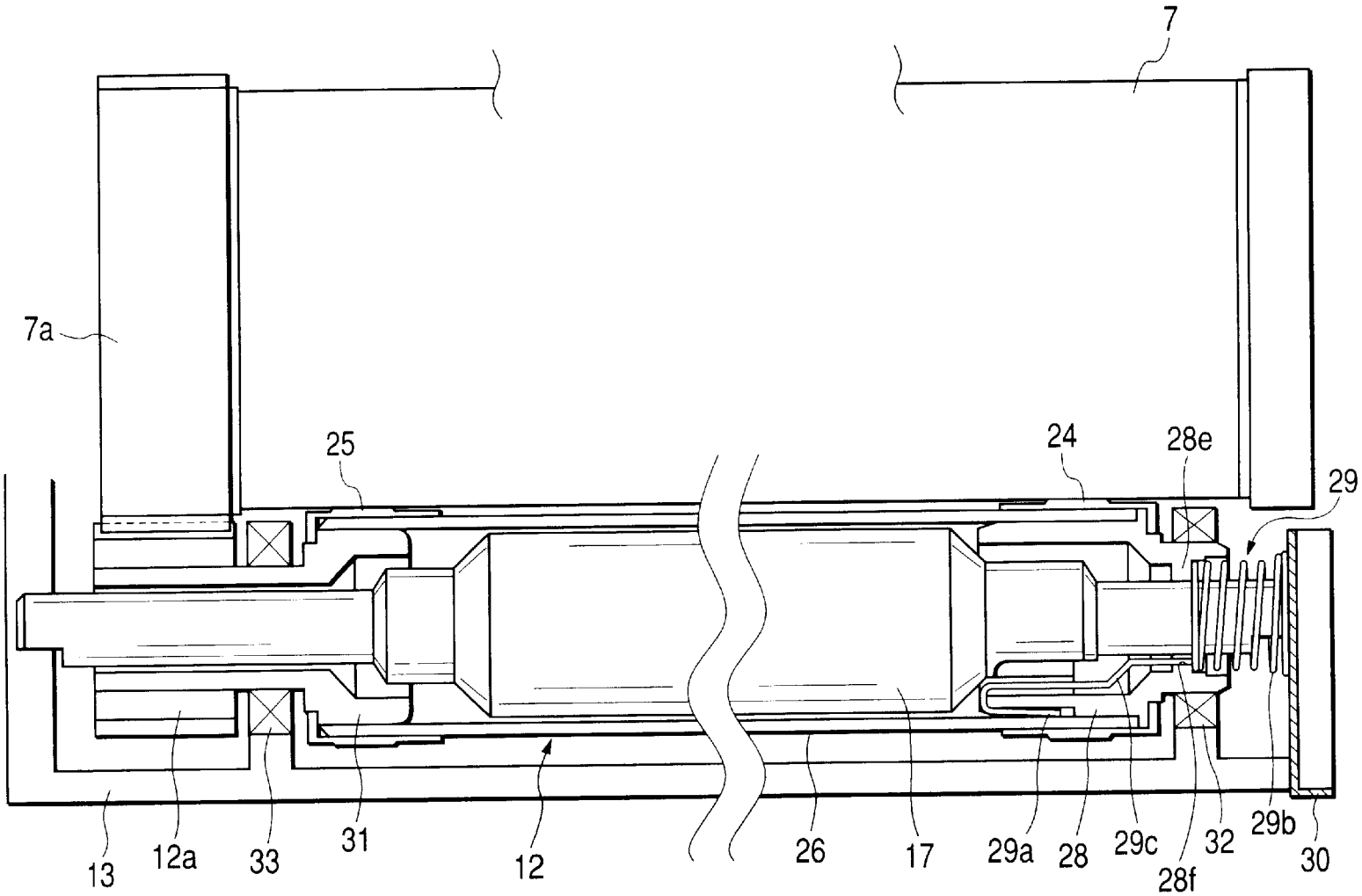
FIG. 1 is a cross section showing a sleeve electrode construction of a development sleeve of the present invention.
Figure 2:
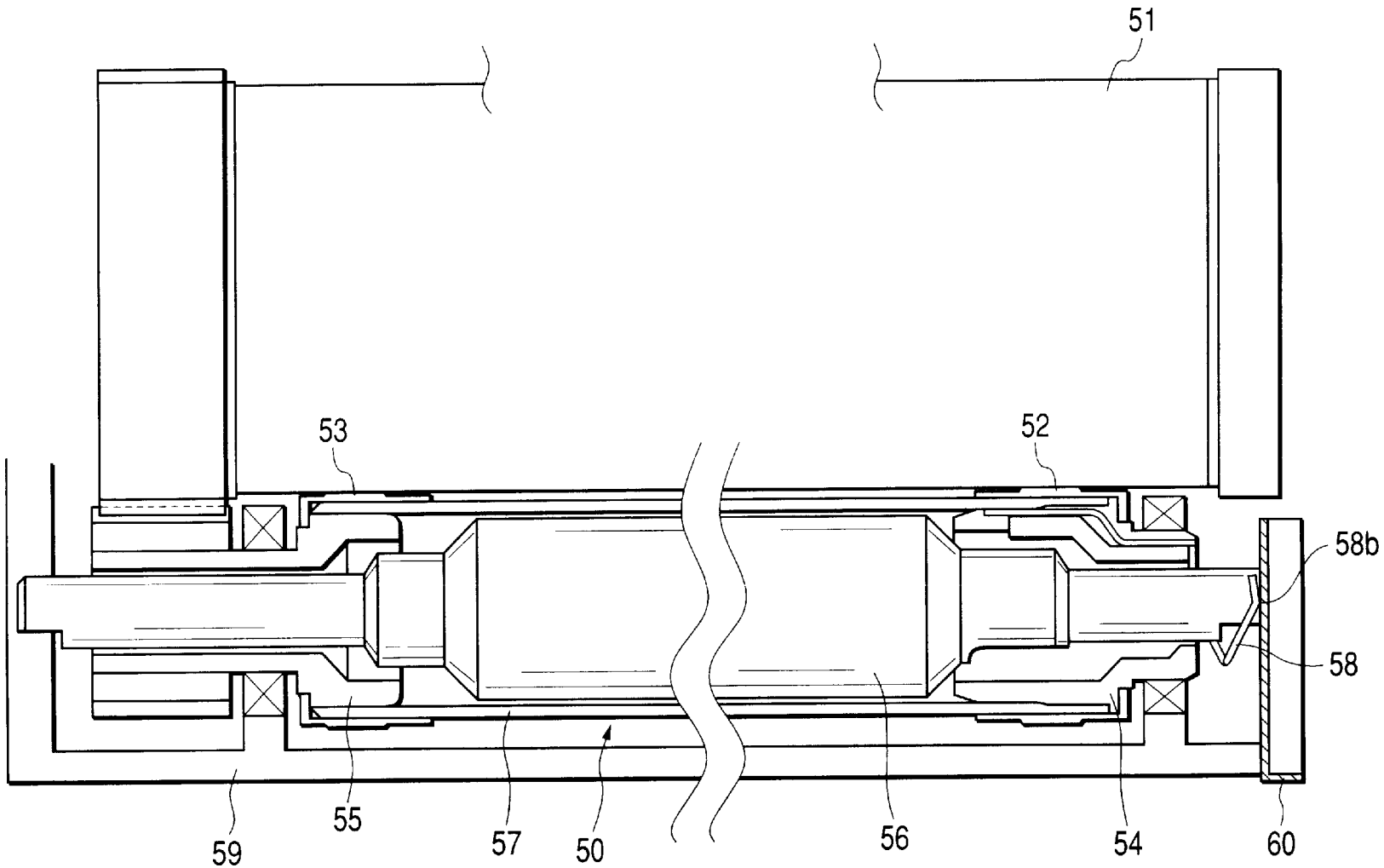
FIG. 2 PRIOR ART
FIG. 2 is a cross section showing a sleeve electrode construction of a conventional development sleeve.
Figure 3:
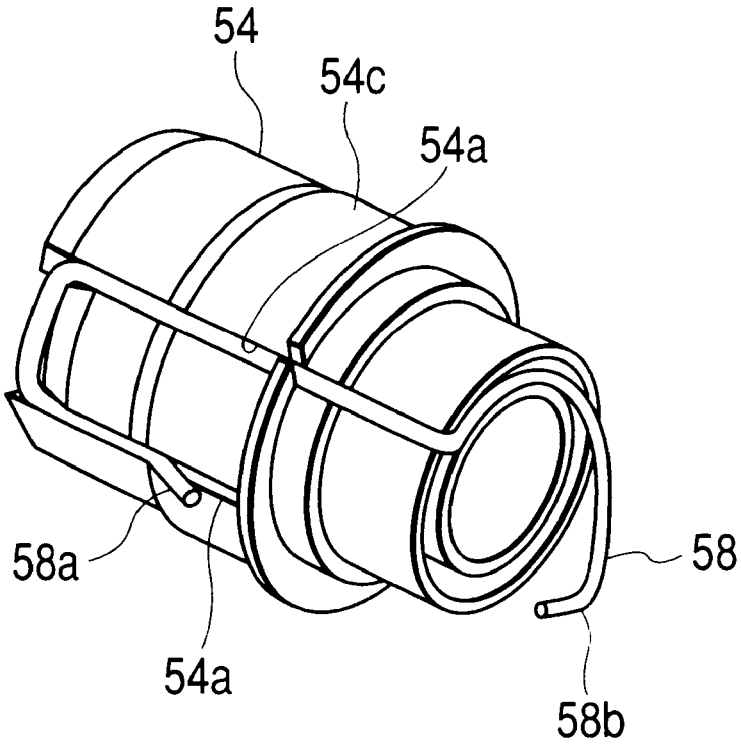
FIG. 3 PRIOR ART
FIG. 3 is a perspective view showing the sleeve electrode construction of the conventional sleeve flange.

Next, the construction of the development sleeve 12 of the present invention will be described with reference to FIG. 1. FIG. 1 is a cross section showing the development sleeve 12 and the photosensitive drum 7 taken along their axial directions.

In the embodiment, which will be described in the following, a sleeve electrode (an electric contact member) 29 is attached to a sleeve flange 28 to be force-fitted into the sleeve cylinder 26. The sleeve electrode 29 includes a coil spring 29*b* electrically connectable to a development bias electrode (a frame side electrode) 30, a contact portion 29*a* to be electrically connected with the sleeve cylinder 26, and a connecting portion 29*c* connecting the contact portion 29*a* and the coil spring 29*b*. The connecting portion 29*c* is disposed in the inside of the sleeve flange 28. Thereby, the accuracy of the sleeve flange 28 can be improved, which improves the qualities of images. Moreover, even if the rotation speed of the development sleeve 12 is fast, the contact of the contact portion between the sleeve electrode 29 and the development bias electrode 30 becomes stable.

The photosensitive drum 7 is rotatably supported by the cleaning frame 9*c*, though the fact is omitted from being shown in FIG. 1. The development sleeve 12 is disposed with a predetermined space from the photosensitive drum 7 with spacer runners 24 and 25 that are rotatably fitted onto the both ends of the development sleeve 12. The development sleeve 12 is composed of the sleeve cylinder 26 of the cylindrical aluminum pipe, the magnet roller 17 built in the sleeve cylinder 26, the sleeve flanges 28 and 31 made of resin, the sleeve electrode 29 as the electric contact member for applying a developing bias to the development sleeve 12, and the like.

One end or both of the ends of the magnet roller 17 are fixed on the developing frame 13, and then the magnet roller 17 is structured in a non-rotation structure.

The cylindrical sleeve cylinder 26 is disposed to be spaced from the magnet roller 17 to surround the magnet roller 17. The sleeve flanges 28 and 31 are fitted into both of the ends of the sleeve cylinder 26. The sleeve flanges 28 and 31 are rotatably supported by bearings 32 and 33, respectively. The bearings 32 and 33 are supported by the developing frame 13. Consequently, the development sleeve 12 is supported by the developing frame 13. When a drum gear 7*a* coaxially fixed on the photosensitive drum 7 rotates, a sleeve gear 12*a* engaging with the drum gear 7*a* rotates to rotate the sleeve flange 31, on which the sleeve gear 12*a* is fixed, together with the sleeve gear 12*a*. Then, the sleeve cylinder 26 rotates on the outer periphery side of the magnet roller 17, and the toner adhered to the sleeve cylinder 26 is carried to the photosensitive drum 7.

The sleeve electrode 29 as the electric contact member is made of an electrically conductive member, and is attached to the sleeve flange 28 fitted onto one end (right end portion in FIG. 1) of the magnet roller 17. The coil spring 29*b* is formed on one end of the sleeve electrode 29, and the coil spring 29*b* is contacted with and electrically connected to the development bias electrode 30 as the frame side electrode, attached to the cartridge frame (developing frame 13) of the process cartridge B. The contact portion of the coil spring 29*b* with the developing bias electrode 30 is a first contact portion electrically connectable with the frame side electrode of the developing device. The development bias electrode 30 is formed into the shape of plane, a normal line of which is the axial line of the development sleeve 12. The end portion of the coil spring 29*b* contacting the development bias electrode 30 is formed into the shape of a torus, which is in contact with the plane surface of the development bias electrode 30 in the substantially entire area of the torus.

On the other end portion of the sleeve electrode 29, the contact portion 29*a* for electrically connecting with the sleeve cylinder 26 is formed. The contact portion 29*a* is a second contact portion to be electrically connected with the sleeve cylinder 26 of the development sleeve 12. The coil spring 29*b* and the contact portion 29*a* are connected with each other through the connecting portion 29*c* positioned in the inside of the sleeve flange 28, and the coil spring 29*b*, the connecting portion 29*c* and the contact portion 29*a* are formed with a line material.

Figure 6:
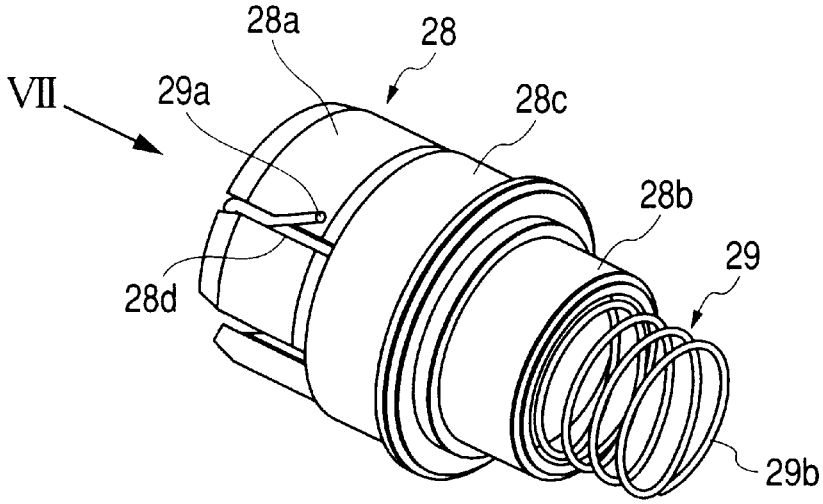
FIG. 6 is a perspective view showing a sleeve electrode construction of a sleeve flange of the invention.

FIG. 6 is a perspective view showing a state in which the sleeve electrode 29 is attached to the sleeve flange 28. A force-fit portion 28*c* that is force-fitted into the sleeve cylinder 26, to be fit into the inner peripheral surface of the sleeve cylinder 26, is formed in the sleeve flange 28. The force-fit portion 28*c* is shaped in a cylinder shape, and a high circularity of the outer peripheral surface of the force-fit portion 28*c* is required because the outer peripheral surface influences the shape of the sleeve cylinder 26.

On the insertion side of the sleeve flange 28 into the sleeve cylinder 26, a guide portion 28*a* having a diameter smaller than that of the force-fit portion 28*c* is formed for guiding the insertion of the sleeve flange 28 into the sleeve cylinder 26. When the sleeve flange 28 is force-fitted into the sleeve cylinder 26, the guide portion 28*a* is first inserted into the cylinder of the sleeve cylinder 26, and then the force-fit portion 28*c* is force-fitted into the cylinder, so that the sleeve flange 28 is fitted into the sleeve cylinder 26.

A shaft portion 28*b* for supporting the development sleeve 12 rotatably is formed in the sleeve flange 28. The shaft portion 28*b* is rotatably supported by the bearing 32.

The coil spring 29*b* is disposed in the inner diameter portion of the shaft portion 28*b*, and the connecting portion 29*c* continued to the coil spring 29*b* is laid on the inner periphery side of the sleeve flange 28. The connecting portion 29*c* is bent at the end portion of the guide portion 28*a*, and laid on the outer periphery side of the guide portion 28*a*. And then the connecting portion 29*c* is fitted into a groove 28*d* formed in the guide portion 28*a*. The end portion of the connecting portion 29*c* is bent to the outside to form a contact portion 29*a*, which is projected from the guide portion 28*a*. Hereupon, the groove 28*d* is formed on the outer periphery of the guide portion 28*a* in the axial direction thereof.

Figure 7:
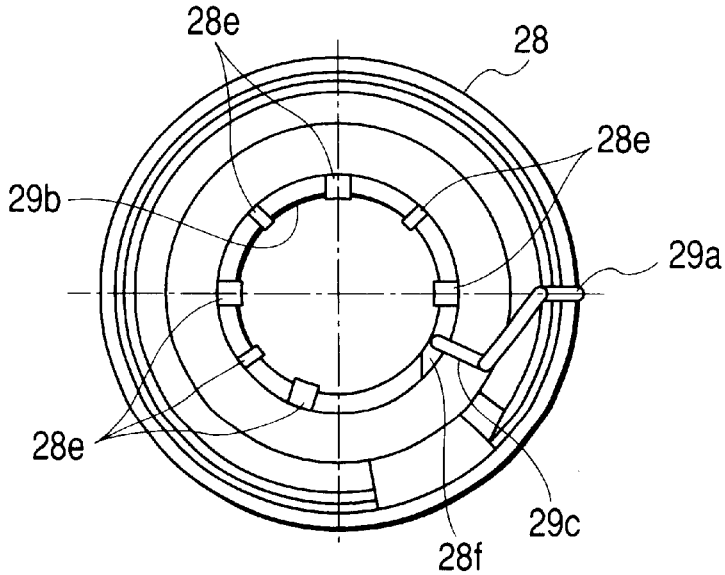
FIG. 7 is a plan view of the sleeve flange of the invention as viewed from a sleeve cylinder insertion side.

FIG. 7 is a view of the sleeve flange 28 and the sleeve electrode 29 as viewed from the guide portion 28*a* side (as looking along the direction indicated by the arrow VII in FIG. 6). Ribs 28*e* and 28*f* are disposed on the inner diameter portion of the shaft portion 28*b* in a state of being allotted in the peripheral direction. The ribs 28*e* and 28*f* serve as a seat portion (on the back side of the drawing sheet) for the attachment of the coil spring 29*b* of the sleeve electrode 29. Moreover, the sleeve electrode 29 is positioned to the sleeve flange 28 by the fitting of the contact portion 29*a* into the groove 28*d* of the sleeve flange 28 (see FIG. 6) and by the regulation of the position of the connecting portion 29*c* by the rib 28*f*.

A summation of the aforesaid embodiment would be as follows.

In an electric contact member for applying a development bias voltage to a development sleeve for developing an electrostatic latent image formed on an electrophotographic photosensitive member, a flange is force-fitted into one end portion of a cylinder of the development sleeve; the electric contact member includes a first contact portion that is attached to the flange and is capable of being electrically connected with a frame side electrode attached to a frame to which the development sleeve is attached, a second contact portion to be electrically connected with the cylinder, and a connecting portion for connecting the first contact portion and the second contact portion; the first contact portion is a coil spring formed on one end of the electric contact member; the second contact portion is formed on the other end of the electric contact member, and the second contact portion is an projection portion projecting from the flange; and the connecting portion is disposed in the inside of the flange.

Hereupon, the flange includes a cylindrical force-fit portion to be force-fitted into the cylinder, and an insertion guide portion having a diameter smaller than that of the force-fit portion, and the second contact portion is attached to the insertion guide portion.

Moreover, the flange includes a plurality of ribs on its inner diameter portion, which ribs are seat portions for the coil spring being the first contact portion and regulate a position of the connecting portion.

With this construction, it becomes unnecessary to form a groove or the like described with regard to the conventional art in the force-fit portion 28*c* into the sleeve cylinder 26 of the sleeve flange 28, and the force-fit portion 28*c* can be formed to be a complete circle. Consequently, the accuracy (circularity) of the force-fit portion 28*c* can be improved, and the circularity of the spacer-runner abutting portion of the sleeve cylinder 26 can be improved. Thereby, the changes in the gap between the photosensitive drum 7 and the development sleeve 12 can be reduced, and then an image having high quality can be obtained.

Moreover, because the contact portion of the sleeve electrode 29 and the development bias electrode 30 is an end portion of the winding of the coil spring 29*b* and the contact pressure between the sleeve electrode 29 and the development bias electrode 30 does not concentrate to one point consequently, the scraping of the electrodes 29 and 30 is difficult to occur and sure conduction between them can be obtained. Electric noises also are difficult to be generated.

The use of the sleeve flange and the sleeve electrode of the present embodiment make it possible to improve the accuracy of the sleeve flange and the quality of images.

Moreover, even if the rotation speed of the development sleeve is fast, the contact of the contact portion between the sleeve electrode and the development bias electrode becomes stable, and consequently, even if the using time of the electric contact member is long, the scraping of the electrodes can be decreased, and the sure conduction can be obtained. The generation of electrical noises and frictional sounds becomes difficult.

As described above, according to the present invention, a development bias voltage can stably be applied to a development sleeve.

While the invention has been described with reference to the structure disclosed herein, it is not confined to the details set forth and this application is intended to cover such modifications or changes as many come within the purposes of the improvements or the scope of the following claims.

What is claimed is:

1. An electric contact member for applying a development bias voltage to a development sleeve for developing an electrostatic latent image formed on an electrophotographic photosensitive drum, said electric contact member being used by being attached to a flange to be attached to an end portion of the development sleeve, said electric contact member comprising:

a coil spring portion electrically connectable to a frame side electrode formed on a frame supporting the development sleeve, said coil spring portion projecting from one end portion of the flange when said electric contact member is attached to the flange;

a contact portion contacting an inner surface of the development sleeve when the flange, to which said electric contact member is attached, is attached to the end portion of the development sleeve, said contact portion projecting from the other end portion of the flange when said electric contact member is attached to the flange; and a connecting portion for connecting said coil spring portion and said contact portion, said connecting portion being disposed inside of the flange when said electric contact member is attached to the flange, wherein the flange includes a plurality of ribs extending along an axial direction thereof and disposed on an inner surface thereof along a circumferential direction thereof, and wherein when said electric contact member is attached to the flange, said connecting portion is positioned between adjacent ribs of said plurality of ribs and the attachment position of said connecting portion is regulated in the circumferential direction by said adjacent ribs.

2. An electric contact member according to claim 1, wherein the flange includes a cylindrical force-fit portion to be force-fitted into the development sleeve, and an insertion guide portion having a diameter smaller than the diameter of the force-fit portion, and said contact portion is attached to the insertion guide portion of the flange when said electric contact member is attached to the flange.

3. An electric contact member according to claim 1 or 2, wherein when said electric contact member is attached to the flange, said coil spring portion sits on said plurality of ribs as attachment-seat surfaces and the attachment position of said connecting portion is regulated in the axial direction by said plurality of ribs.

4. A developing device to be used for an electrophotographic image-forming apparatus, said device comprising:

a development sleeve for developing an electrostatic latent image formed on an electrophotographic photosensitive drum;

a flange attached to an end portion of said development sleeve; and an electric contact member for applying a development bias voltage to said development sleeve, said electric contact member being attached to said flange, said electric contact member including:

a coil spring portion electrically connectable with a frame side electrode provided on a frame supporting said development sleeve, said coil spring portion being projected from one end portion of said flange;

a contact portion contacting an inner surface of said development sleeve, said contact portion being projected from the other end portion of said flange; and a connecting portion for connecting said coil spring portion and said contact portion, said connecting portion being disposed inside of said flange, wherein said flange includes a plurality of ribs extending along an axial direction thereof and disposed on an inner surface thereof along a circumferential direction thereof, and wherein said connecting portion is positioned between adjacent ribs of said plurality of ribs and the attachment position of said connecting portion is regulated in the circumferential direction by said adjacent ribs.

5. A developing device according to claim 4, wherein said flange includes a cylindrical force-fit portion to be force-fitted into said development sleeve, and an insertion guide portion having a diameter smaller than the diameter of said force-fit portion, and said contact portion is attached to said insertion guide portion of said flange.

6. A developing device according to claim 4 or 5, wherein said coil spring portion sits on said plurality of ribs as attachment-seat surfaces, and the attachment position of said connecting portion is regulated in the axial direction by said plurality of ribs.

7. A process cartridge detachably mountable to a main body of an electrophotographic image-forming apparatus, said cartridge comprising:

an electrophotographic photosensitive drum;

a development sleeve for developing an electrostatic latent image formed on said electrophotographic photosensitive drum;

a flange attached to an end portion of said development sleeve; and an electric contact member for applying a development bias voltage to said development sleeve, said electric contact member being attached to said flange, said electric contact member including:

a coil spring portion electrically connectable to a frame side electrode provided on a frame supporting said development sleeve, said coil spring portion being projected from one end portion of said flange;

a contact portion contacting an inner surface of said development sleeve, said contact portion being projected from the other end portion of said flange; and a connecting portion for connecting said coil spring portion and said contact portion, said connecting portion being disposed inside of said flange, wherein said flange includes a plurality of ribs extending along an axial direction thereof and disposed on an inner surface thereof along a circumferential direction thereof, and wherein said connecting portion is positioned between adjacent ribs of said plurality of ribs and the attachment position of said connecting portion is regulated in the circumferential direction by said adjacent ribs.

8. A process cartridge according to claim 7, wherein said flange includes a cylindrical force-fit portion to be force-fitted into said development sleeve, and an insertion guide portion having a diameter smaller than the diameter of said force-fit portion, and said contact portion is attached to said insertion guide portion of said flange.

9. A process cartridge according to claim 7 or 8, wherein said coil spring portion sits on said plurality of ribs as attachment-seat surfaces, and the attachment position of said connecting portion is regulated in the axial direction by said plurality of ribs.

10. A process cartridge according to claim 7 or 8, further comprising at least one of:

charging means for charging said electrophotographic photosensitive drum; and cleaning means for removing toner remaining on said electrophotographic photosensitive drum.

11. An electrophotographic image-forming apparatus for forming an image on a recording medium, said electrophotographic image-forming apparatus comprising:

an electrophotographic photosensitive drum;

a development sleeve for developing an electrostatic latent image formed on said electrophotographic photosensitive drum;

a flange attached to an end portion of said development sleeve;

an electric contact member for applying a development bias voltage to said development sleeve, said electric contact member being attached to said flange, said electric contact member including:

a coil spring portion electrically connectable to a frame side electrode provided on a frame supporting said development sleeve, said coil spring portion being projected from one end portion of said flange;

a contact portion contacting an inner surface of said development sleeve, said contact portion being projected from the other end portion of said flange; and a connecting portion for connecting said coil spring portion and said contact portion, said connecting portion being disposed inside of said flange; and transporting means for transporting the recording medium, wherein said flange includes a plurality of ribs extending along an axial direction thereof and disposed on an inner surface thereof along a circumferential direction thereof, and wherein said connecting portion is positioned between adjacent ribs of said plurality of ribs and the attachment position of said connecting portion is regulated in the circumferential direction by said adjacent ribs.

12. An electrophotographic image-forming apparatus for forming an image on a recording medium, said electrophotographic image-forming apparatus comprising:

a mounting portion for detachably mounting a process cartridge; and transporting means for transporting the recording medium, the process cartridge including:

an electrophotographic photosensitive drum;

a development sleeve for developing an electrostatic latent image formed on the electrophotographic photosensitive drum;

a flange attached to an end portion of the development sleeve; and an electric contact member for applying a development bias voltage to the development sleeve, the electric contact member being attached to the flange, the electric contact member having:

a coil spring portion electrically connectable to a frame side electrode provided on a frame supporting the development sleeve, the coil spring portion being projected from one end portion of the flange;

a contact portion contacting an inner surface of the development sleeve, the contact portion being projected from the other end portion of the flange; and a connecting portion for connecting the coil spring portion and the contact portion, the connecting portion being disposed inside of the flange, wherein the flange includes a plurality of ribs extending along an axial direction thereof and disposed on an inner surface thereof along a circumferential direction thereof, and wherein the connecting portion is positioned between adjacent ribs of the plurality of ribs and the attachment position of the connecting portion is regulated in the circumferential direction by the adjacent ribs.

* * * * *

UNITED STATES PATENT AND TRADEMARK OFFICE

CERTIFICATE OF CORRECTION

PATENT NO. : 6,594,454 B2
DATED : July 15, 2003
INVENTOR(S) : Toru Oguma et al.

It is certified that error appears in the above-identified patent and that said Letters Patent is hereby corrected as shown below:

Title page,
Item [56], References Cited, FOREIGN PATENT DOCUMENTS, "JP 05204283 8/1993" should read -- JP 5-204283 8/1993 --.

Column 2,
Lines 56 and 64, "to be" should be deleted.
Line 67, "to" should be deleted.

Column 3,
Line 1, "be" should be deleted.

Column 8,
Line 66, "many" should read -- may --.

Signed and Sealed this

Third Day of February, 2004

JON W. DUDAS
*Acting Director of the United States Patent and Trademark Office*